US012653333B2

(12) United States Patent
Shahrukh et al.

(10) Patent No.: US 12,653,333 B2
(45) Date of Patent: Jun. 16, 2026

(54) FITTED SHEET FOR MULTIPLE MATTRESS HEIGHTS

(71) Applicant: Yunus Textile Mills Ltd., Sindh (PK)

(72) Inventors: Syed Moosa Shahrukh, Karachi (PK); Haider Bokhary, Karachi (PK)

(73) Assignee: Yunus Textile Mills Ltd., Sindh (PK)

( * ) Notice: Subject to any disclaimer, the term of this patent is extended or adjusted under 35 U.S.C. 154(b) by 0 days.

(21) Appl. No.: 18/804,384

(22) Filed: Aug. 14, 2024

(65) Prior Publication Data

US 2025/0057339 A1 Feb. 20, 2025

Related U.S. Application Data

(60) Provisional application No. 63/532,463, filed on Aug. 14, 2023.

(51) Int. Cl.
*A47G 9/02* (2006.01)

(52) U.S. Cl.
CPC ..... *A47G 9/0246* (2013.01)

(58) Field of Classification Search
CPC ..... A47G 9/02; A47G 9/0238; A47G 9/0246; A47C 31/10; A47C 31/105; A47C 27/002; A47C 27/003; A47C 27/005; A47C 27/006; A47C 27/007; A47C 27/008

See application file for complete search history.

(56) References Cited

U.S. PATENT DOCUMENTS

| | | | | |
|---|---|---|---|---|
| 2,994,094 | A * | 8/1961 | Hester | A47G 9/0246 5/497 |
| 3,013,283 | A * | 12/1961 | Steffinich | A47G 9/0246 5/497 |
| 3,940,812 | A * | 3/1976 | DiForti | A43B 9/00 D6/606 |
| 4,703,530 | A | 11/1987 | Gusman | |
| 4,980,941 | A | 1/1991 | Johnson, III | |
| 8,856,984 | B1 | 10/2014 | Donham | |
| 9,259,107 | B2 * | 2/2016 | Lilienthal | A47G 9/02 |
| 9,795,231 | B2 * | 10/2017 | Smith | A47G 9/0246 |
| 9,999,307 | B2 | 6/2018 | Feldman | |
| 10,251,498 | B1 * | 4/2019 | Feldman | A47G 9/0246 |

(Continued)

FOREIGN PATENT DOCUMENTS

WO WO-2017216535 A1 * 12/2017 ..... A47G 9/0246

*Primary Examiner* — David E Sosnowski
(74) *Attorney, Agent, or Firm* — Lerner David LLP

(57) ABSTRACT

A fitted covering for a mattress configured to accommodate mattress and mattress pads of different heights. The fitted sheet includes a top panel integrally formed with a plurality of side panels and a bottom panel. Each of the plurality of side panels are connected at their edges to form corner pockets, the corner pockets including elastic material disposed between parallel vertical stitching, with horizontal stitching running across the parallel vertical stitching and elastic material. The elastic material within the pockets is configured to stretch to fit mattresses and/or mattress pads of various heights. The bottom panel may include an opening mimicking the shape of a mattress. The opening is configured for inserting the mattress into the fitted covering. The bottom panel may include elastic material circumscribing the opening. The bottom panel is designed to tension the fitted sheet around mattresses of various sizes to prevent slippage.

10 Claims, 1 Drawing Sheet

(56) References Cited

U.S. PATENT DOCUMENTS

| | | | | |
|---|---|---|---|---|
| 2004/0078898 | A1* | 4/2004 | Cushing | A47G 9/0246 5/497 |
| 2009/0106900 | A1* | 4/2009 | Wootten, Jr. | A47G 9/0246 5/497 |
| 2009/0106901 | A1* | 4/2009 | Wootten, Jr. | A47G 9/0246 5/497 |
| 2011/0023234 | A1* | 2/2011 | Bolish | A47G 9/0238 5/496 |
| 2012/0054962 | A1* | 3/2012 | Agarwall | A47G 9/0246 5/497 |
| 2012/0260424 | A1* | 10/2012 | Agarwall | A47G 9/0246 493/393 |
| 2014/0109315 | A1* | 4/2014 | Lilienthal | A47G 9/0246 5/497 |
| 2015/0135402 | A1* | 5/2015 | McCourt | A41D 19/00 2/163 |
| 2018/0242763 | A1* | 8/2018 | Binali | A47G 9/0246 |
| 2019/0090665 | A1* | 3/2019 | Tak | A47G 9/04 |
| 2020/0288889 | A1* | 9/2020 | Tak | A47G 9/0246 |
| 2022/0395116 | A1* | 12/2022 | Balakrishnan | A47G 9/0246 |

* cited by examiner

FITTED SHEET FOR MULTIPLE MATTRESS HEIGHTS

CROSS-REFERENCE TO RELATED APPLICATIONS

This application claims the benefit of the filing date of U.S. Provisional Patent Application No. 63/532,463 filed Aug. 14, 2023, the disclosure of which is hereby incorporated herein by reference.

BACKGROUND OF THE INVENTION

Fitted sheets are necessary to protect the surface of mattresses and mattress pads. Overtime, mattresses and mattress pads have increased in height for a more luxurious appearance and feel. This increase in height has resulted in difficulties in properly selecting a fitted sheet of an appropriate size. A fitted sheet that is too small will slip off a mattress, while a fitted sheet that is too large will result in a loose fit and sloppy appearance. Thus, there is a need for a fitted sheet that is capable of accommodating mattresses and mattress pads of various heights.

BRIEF SUMMARY OF THE INVENTION

One aspect of the present invention relates to a fitted sheet or covering configured to accommodate mattresses of different heights. The fitted sheet is further compatible with, but not limited to, memory foam toppers, box springs with a mattress, box springs with a mattress and mattress topper, multiple-layer mattresses, inflatable mattresses, and extra deep beds. The fitted sheet may comprise a top panel integrally formed with a plurality of side panels and a bottom panel. Each of the plurality of side panels may be connected at their edges to form corner pockets. Each of the corner pockets may include a vertical elastic material disposed between a first vertical stitching, and a second vertical stitching, and a horizontal stitching running across the first and second vertical stitching and vertical elastic material. The bottom panel may define an opening and may include an elastic material running along an entire periphery of the opening.

BRIEF DESCRIPTION OF THE DRAWINGS

The present invention will become more fully understood from the detailed description and accompanying drawings, wherein.

DETAILED DESCRIPTION

Figure 1:
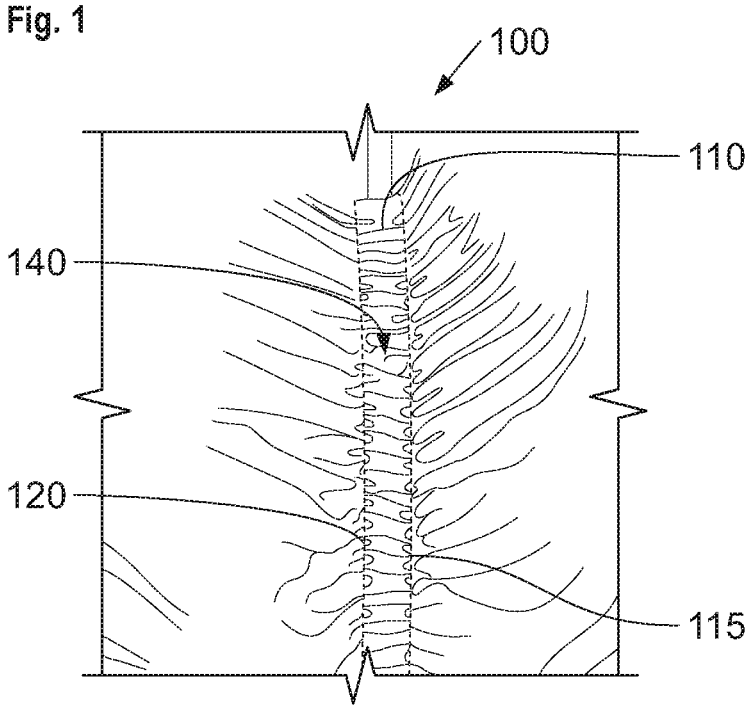
FIG. 1 is a partial perspective view of the fitted sheet according to an embodiment of the present invention.
Figure 2:
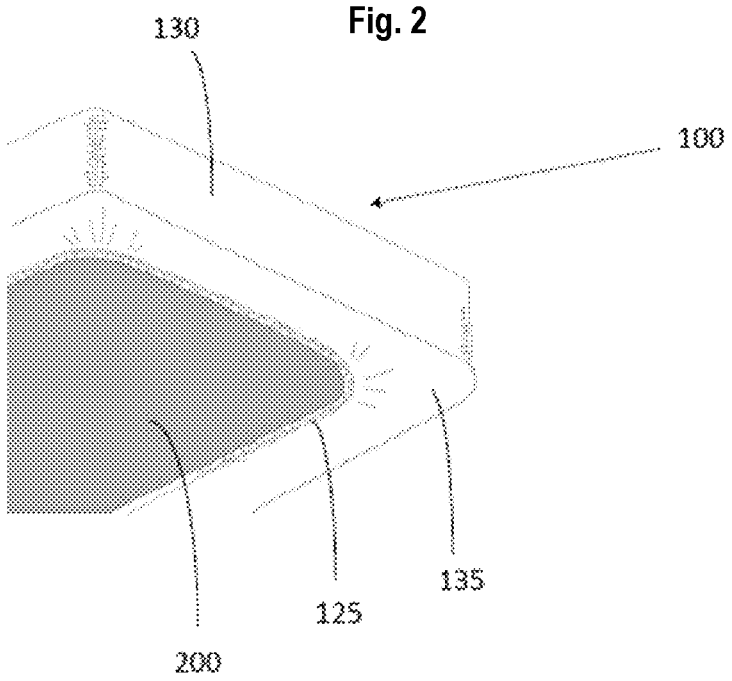
FIG. 2 is a partial perspective view of a mattress encased by the fitted sheet of FIG. 1.

FIGS. 1-2 depict an embodiment of the present invention in which fitted sheet 100 encases a mattress 200. Specifically, the fitted sheet 100 is configured to fit a multitude of mattress heights. As depicted in FIG. 2, the fitted sheet 100 may include a top panel, a bottom panel 135, and side panels 130. Each of the side panels 130 is connected to an adjacent side panel along a seam incorporating elastic material 140 to define a corner of fitted sheet 100. As depicted in FIG. 1, each corner seam of fitted sheet 100 is comprised of a doubled stitching in which horizontal stitching 110 runs horizontally across parallel vertical stitches 115 and 120.

The horizontal stitching 110 running across elastic material 140 and vertical stitching 115 and 120 tensions adjacent side panels 130 towards one another while allowing the elastic material 140 to stretch in the vertical direction to accommodate mattresses and mattress pads of various heights. As a result, the corners of fitted sheet 100 define a pocket adapted to hug the corner of any mattresses 200 without slipping or sagging.

Fitted sheet 100 may further include an elastic material 125 running along the entire periphery of the bottom panel 135. Elastic 125 is arranged to cinch each portion of bottom panel 135 towards a center of mattress 200 when fitted sheet 100 encases the mattress thereby securing the fitted sheet to the mattress regardless of the height of the mattress.

Fitted sheet 100 may fit mattress heights ranging from 9 and 18 inches. Specifically, in one embodiment, when in an unstretched condition, the vertical elastic material 140 may be a length of 9 inches, and when in a fully stretched condition the vertical elastic material 140 may be a length of 18 inches.

The invention claimed is:

1. A fitted covering for a mattress, comprising:

a top panel integrally formed with a plurality of side panels and a bottom panel, each of the plurality of side panels is connected at their edges to form corner pockets, each of the corner pockets includes a vertical elastic material having a longitudinal dimension oriented vertically and disposed between a first vertical stitching, and a second vertical stitching, wherein a plurality of horizontal stitches run horizontally across the vertical elastic material at a plurality of locations spaced apart at intervals along the longitudinal dimension of the vertical elastic material from the upper terminal of the vertical elastic material to the lower terminal of the vertical elastic material.

2. The fitted covering of claim 1, wherein the bottom panel defines an opening and includes peripheral elastic material running along at least a portion of a periphery of the opening.

3. The fitted covering of claim 2, wherein the peripheral elastic material runs along the entire periphery of the opening.

4. The fitted covering of claim 1, wherein the peripheral elastic material is arranged to cinch each portion of the bottom panel towards a center of a mattress.

5. The fitted covering of claim 4, wherein the peripheral elastic material arranged to cinch each portion of the bottom panel is 0.75 inches wide.

6. A fitted covering for a mattress, comprising:

a top panel integrally formed with a plurality of side panels and a bottom panel, each of the plurality of side panels is connected at their edges to form corner pockets, each of the corner pockets includes a vertical elastic material having a longitudinal dimension oriented vertically and disposed between a first vertical stitching and a second vertical stitching, wherein a plurality of horizontal stitches exclusively disposed between the first and second vertical stitching run horizontally across the vertical elastic material at a plurality of locations spaced apart at intervals along the longitudinal dimension of the vertical elastic material from the upper terminal of the vertical elastic material to the lower terminal of the vertical elastic material.

7. The fitted covering of claim 6, wherein the bottom panel defines an opening and includes a peripheral elastic material running along at least a portion of a periphery of the opening.

8. The fitted covering of claim 7, wherein the peripheral elastic material runs along the entire periphery of the opening.

9. The fitted covering of claim 6, wherein the peripheral elastic material is arranged to cinch each portion of the bottom panel towards a center of a mattress.

10. The fitted covering of claim 9, wherein the peripheral elastic material arranged to cinch each portion of the bottom panel is 0.75 inches wide.

* * * * *